US009993914B2

(12) United States Patent
Gunasekaran et al.

(10) Patent No.: US 9,993,914 B2
(45) Date of Patent: Jun. 12, 2018

(54) HAMMER TOOL ASSEMBLY

(71) Applicant: Caterpillar Inc., Peoria, IL (US)

(72) Inventors: Jayaram Gunasekaran, Chennai (IN); Cody T. Moore, Waco, TX (US); Arun Palanoor, Bangalore (IN); Colins V. Jacob, Bangalore (IN); DineshBabu Padmanabhan, Chennai (IN)

(73) Assignee: Caterpillar Inc., Deerfield, IL (US)

( * ) Notice: Subject to any disclaimer, the term of this patent is extended or adjusted under 35 U.S.C. 154(b) by 491 days.

(21) Appl. No.: 14/835,743

(22) Filed: Aug. 26, 2015

(65) Prior Publication Data

US 2015/0360361 A1 Dec. 17, 2015

(51) Int. Cl.

| | |
|---|---|
| ***B25D 17/00*** | (2006.01) |
| ***E02F 3/96*** | (2006.01) |
| ***E02F 5/30*** | (2006.01) |

(52) U.S. Cl.

CPC ..... *B25D 17/00* (2013.01); *E02F 3/966* (2013.01); *E02F 5/305* (2013.01); *B25D 2250/121* (2013.01)

(58) Field of Classification Search

CPC ..... B25D 17/00; E02F 3/966; E02F 5/305

USPC ..... 173/90

See application file for complete search history.

(56) References Cited

U.S. PATENT DOCUMENTS

| | | | |
|---|---|---|---|
| 5,419,404 | A | 5/1995 | Niemi et al. |
| 2012/0152581 | A1 | 6/2012 | Pillers, II et al. |
| 2014/0144659 | A1 | 5/2014 | Nickels et al. |
| 2014/0262393 | A1 | 9/2014 | Desmeules |
| 2014/0332244 | A1 | 11/2014 | Moore et al. |
| 2014/0332246 | A1 | 11/2014 | Moore et al. |

FOREIGN PATENT DOCUMENTS

| | | |
|---|---|---|
| CN | 201280734 | 7/2009 |
| JP | 2005001063 | 1/2005 |
| KR | 1359322 | 2/2014 |
| WO | 02008139039 | 11/2008 |

*Primary Examiner* — Michelle Lopez

(57) ABSTRACT

A hammer tool assembly for a machine is provided. A hammer tool assembly includes a power cell, a tool and a frame assembly. The frame assembly includes a first side plate and a second side plate. The hammer tool assembly includes a flange member extending from an outer periphery of an outer wall of the first and second side plates. The flange member includes a plurality of serrations that extend from the outer periphery of the outer wall of at least one of the first and second side plates. The hammer tool assembly also includes a plurality of blocks provided in surrounding contact with the power cell and an inner wall of the first and second side plates respectively.

1 Claim, 5 Drawing Sheets

HAMMER TOOL ASSEMBLY

TECHNICAL FIELD

The present disclosure relates to a work tool assembly of a machine, and more particularly to a hammer tool assembly associated with the machine.

BACKGROUND

Machines utilize a variety of tools, such as for example a powered hammer, for performing tasks. The hammer may be used in in cutting through rocks, demolition of structure, etc. The hammer generally includes a housing assembly having side plates, a power cell and a tool extending from the housing. The housing is coupled to the power cell using mechanical fasteners. During operation, the tool strikes against various work surfaces resulting in disintegration of material. Due to the impact and load transfer to the hammer during operation, the bolts experience fatigue. The side plates, generally having a C-shaped cross section, are prone to wear and damage. In some situations side bolts of the hammer are subject to side loads during operation in confined spaces. This may lead to bending or deformation of the side plates. Accordingly an overall operation, efficiency, and productivity of the machine may be affected due to increase in machine downtime.

U.S. Pat. No. 5,419,404, hereinafter referred as the '404 patent, describes a hydraulic impact hammer having a protective casing. The protective casing is made of two side plates. Further, the protective casing is provided with attenuation elements for eliminating the noise and vibration caused by the impact hammer The attenuation elements are arranged in the side plates of the protective casing in a manner such that the attenuation elements can be compressed in at least three directions of the housing while fastening the side plates to each other. However, the '404 patent does not provide a robust design of the hammer for preventing wear and failure of the side plates and the side bolts of the hammer.

SUMMARY OF THE DISCLOSURE

In one aspect of the present disclosure, a hammer tool assembly for a machine is provided. The hammer tool assembly includes a power cell defining a first axis. The hammer tool assembly also includes a tool coupled to one end of the power cell. A frame assembly is coupled to the power cell. The frame assembly includes a first side plate and a second side plate. The first and second side plates are positioned in surrounding contact with the power cell. Further, the each of the first and second side plates has an I-shaped cross section along the first axis and a second axis. The second axis is perpendicular to the first axis. The hammer tool assembly includes a flange member having a plurality of serrations that extend from an outer periphery of an outer wall of at least one of the first and second side plates. The flange member extends perpendicular to the second axis along a third axis. The third axis is perpendicular to the first and second axes respectively. The hammer tool assembly includes a plurality of blocks provided in surrounding contact with the power cell and an inner wall of the first and second side plates respectively. The plurality of blocks is positioned proximate to the one end of the power cell. Further, the plurality of blocks is spaced apart from each other with respect to the first axis. Mounting bores are positioned at one end of the first and second side plates respectively. The mounting bores are arranged to coaxially align with corresponding openings provided on respective sides of each of the plurality of blocks such that the mounting bores and the corresponding openings are configured to receive mechanical fasteners therethrough.

Other features and aspects of this disclosure will be apparent from the following description and the accompanying drawings.

DETAILED DESCRIPTION

Wherever possible, the same reference numbers will be used throughout the drawings to refer to same or like parts. Moreover, references to various elements described herein are made collectively or individually when there may be more than one element of the same type. However, such references are merely exemplary in nature. Any reference to elements in the singular is also to be construed to relate to the plural and vice-versa without limiting the scope of the disclosure to the exact number or type of such elements unless set forth explicitly.

Figure 1:
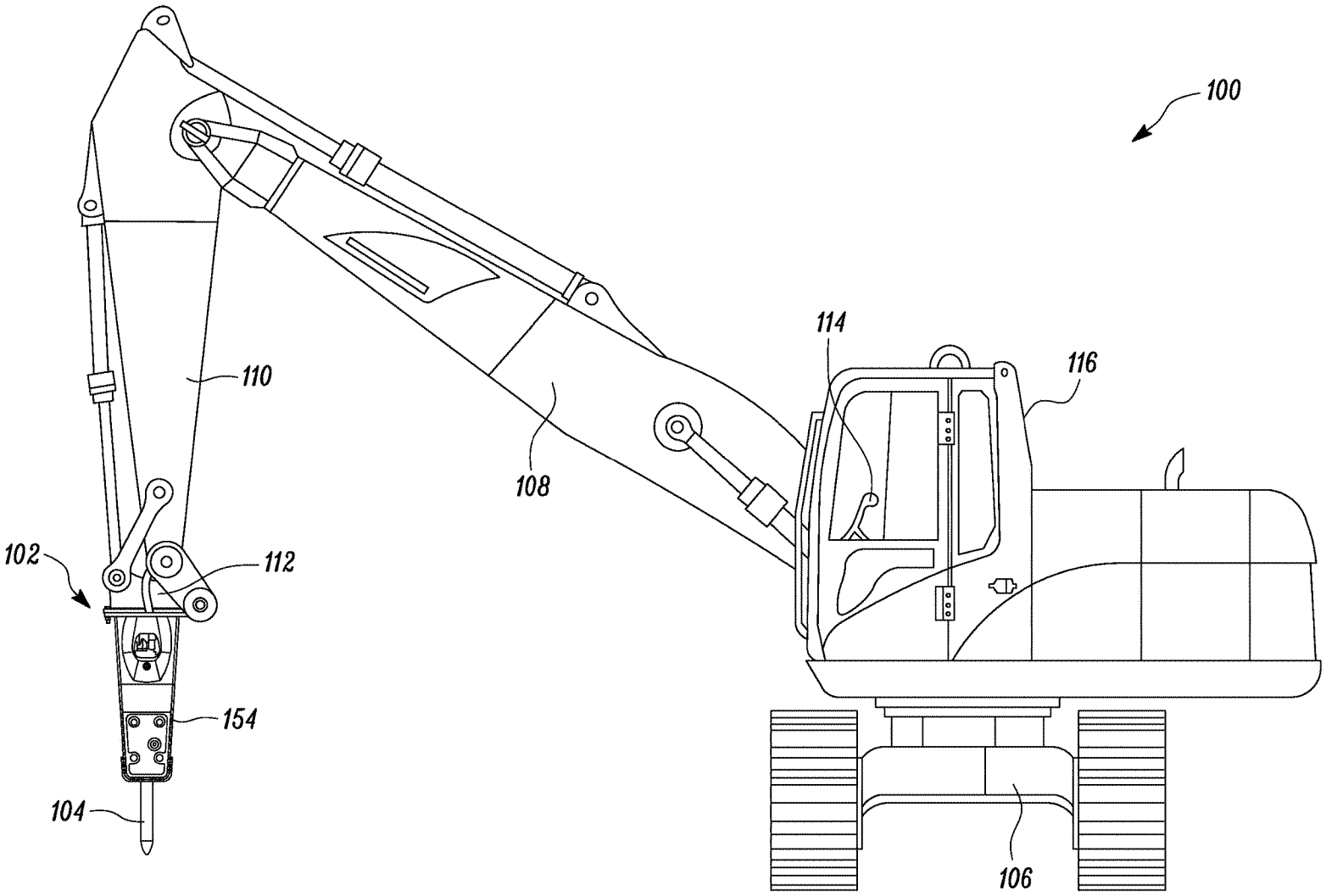
FIG. 1 is a side view of an exemplary machine having a hammer tool assembly, according to one embodiment of the present disclosure.

Referring to FIG. 1, an exemplary machine 100 is illustrated according to one embodiment of the present disclosure. The machine 100 is embodied as a tracked excavator machine. The machine 100 employs a hammer tool assembly 102. The hammer tool assembly 102 includes a tool 104 for breaking rocks and penetrating ground surfaces. The hammer tool assembly 102 is operated by the excavator's hydraulics. However, it can be optionally contemplated to use other types of machines and carriers to power the hammer tool assembly 102 of the present disclosure.

The machine 100 includes a frame 106 and one or more linkages 108, 110. The linkages 108, 110 may be articulated relative to the frame 106 in order to change an orientation and/or position of the hydraulic hammer with respect to a ground surface (not shown). The hammer tool assembly 102 has a flat top design (see FIG. 2). The flat top design includes a pivoting bracket 112. The pivoting bracket 112 pivotally connects the hammer tool assembly 102 to the linkage 110. In an alternate embodiment, the hammer tool assembly 102 may have a pin-on design (not shown) without a top plate. The machine 100 includes an operator control 114 located within a cab 116 of the machine 100. The operator control 114 is used by an operator to operate the hammer tool assembly 102.

Figure 2:
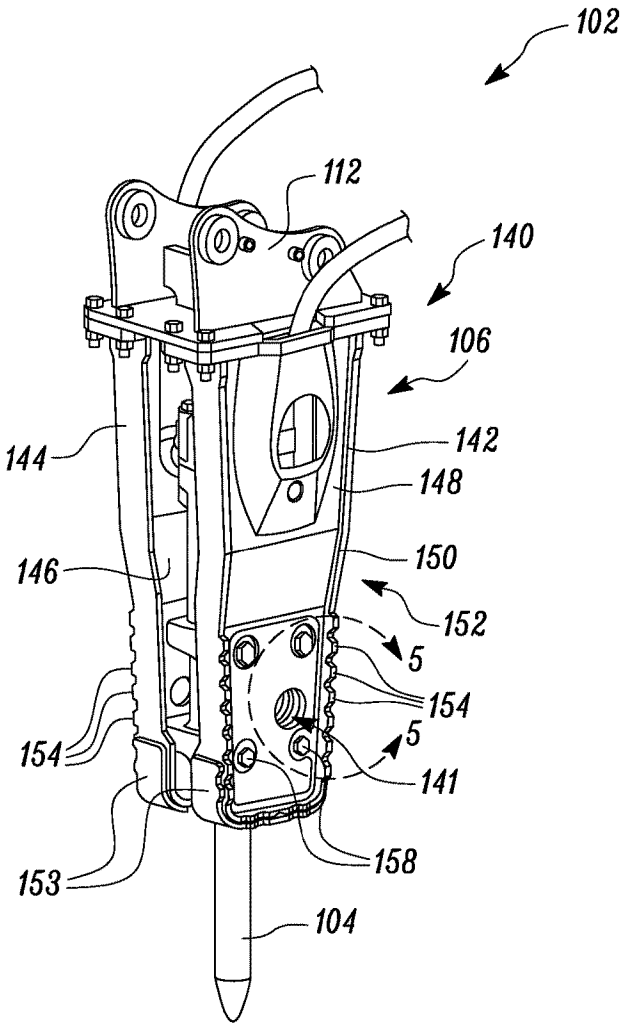
FIG. 2 is a perspective view of the hammer tool assembly of the machine of FIG. 1, according to one embodiment of the present disclosure.
Figure 3:
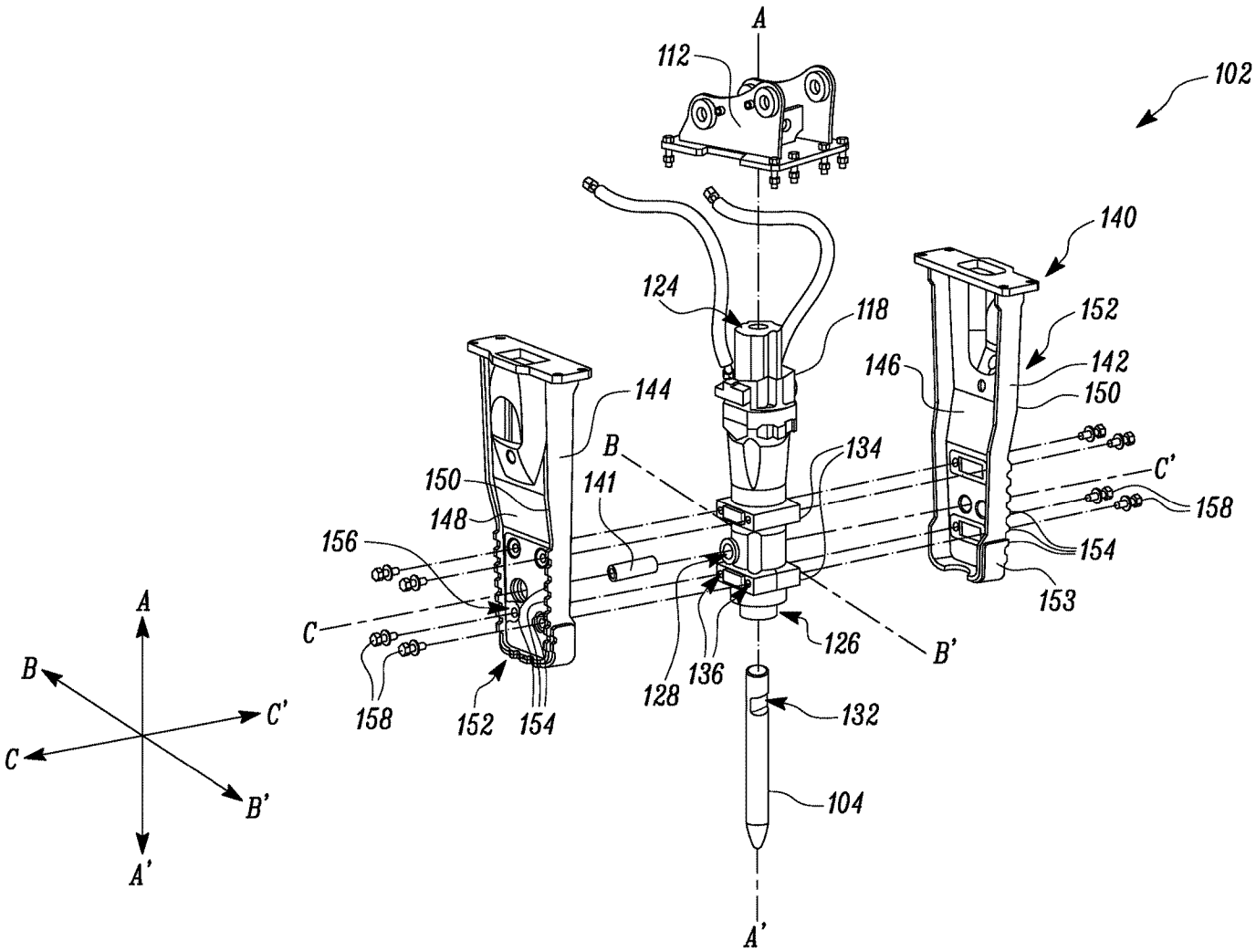
FIG. 3 is a perspective exploded view of the hammer tool assembly of FIG. 2, according to one embodiment of the present disclosure.

Referring to FIGS. 2 and 3 the hammer tool assembly 102 includes a power cell 118. The power cell 118 defines a first axis A-A' and a second axis B-B'. The first axis A-A' extends vertically along a central axis of the hammer tool assembly 102. The second axis B-B' is perpendicular to the first axis A-A'. The power cell 118 has a first end 124 and a second end 126 with respect to the first axis A-A'. The first end 124 of the power cell 118 is configured to receive pressurized fluid during hammering. The second end 126 includes a through hole 128. The through hole 128 is defined along a third axis C-C'. The third axis C-C' is perpendicular to the first and the second axes A-A', B-B' respectively.

The second end 126 of the power cell 118 is coupled to the tool 104. The tool 104 includes a notch 132 provided thereon. The notch 132 on the tool 104 is aligned with the opening 123 to receive a fastener 141 therethrough. The power cell 118 drives the tool 104 of the hammer tool assembly 102 so that the tool 104 performs functions like cutting through rocks, demolition of structure, etc.

Figure 4:
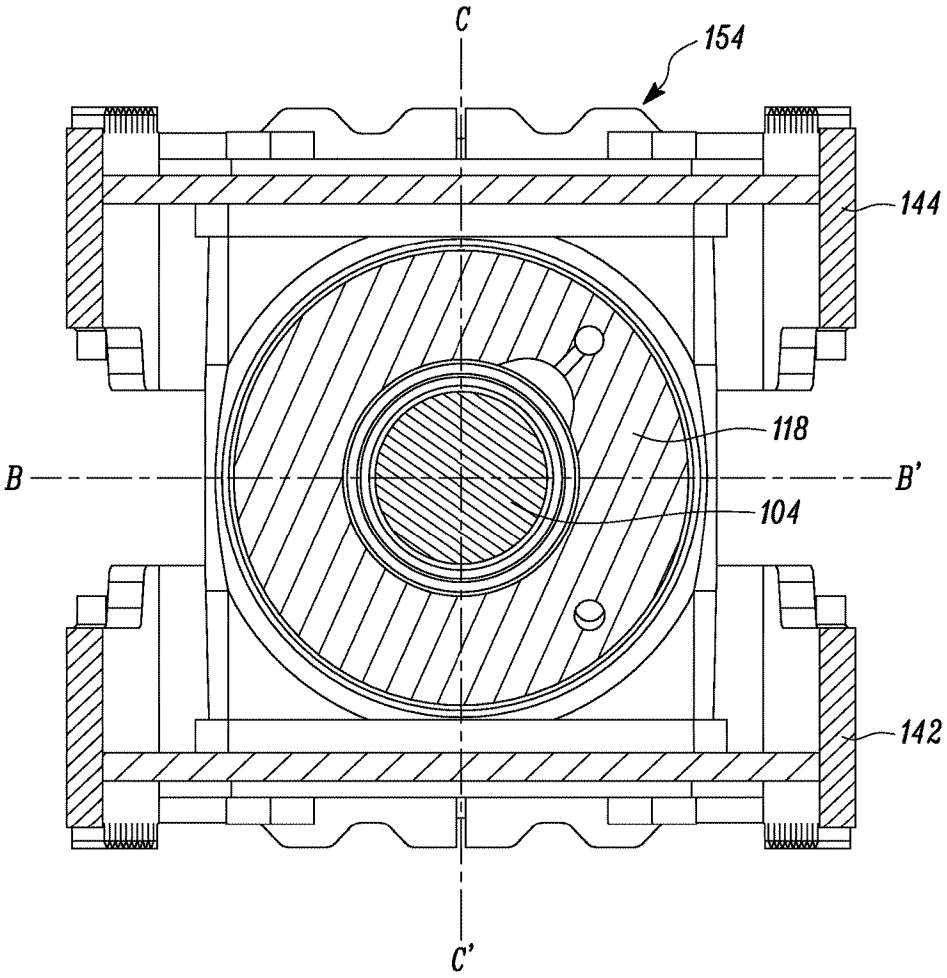
FIG. 4 is a cross-sectional view of the hammer tool assembly of FIG. 2, according to one embodiment of the present disclosure.
Figure 5:
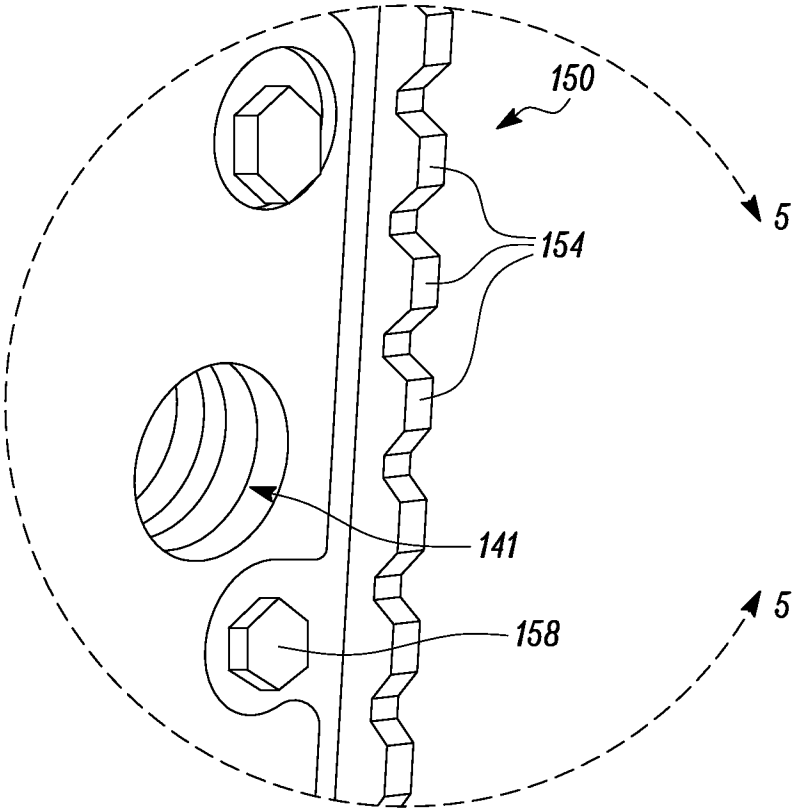
FIG. 5 is an enlarged view of an encircled portion 5-5 of FIG. 2.

Referring to FIG. 3, the hammer tool assembly 102 includes a number of blocks 134 provided in association with the power cell 118. The blocks 134 are positioned proximate to the second end 126 of the power cell 118. The blocks 134 are spaced apart from each other with respect to the first axis A-A'. Although two blocks 134 are shown in the accompanying figures, additional number of blocks 134 may be provided in association with the power cell 118 without deviating from the scope of the present disclosure. Each of the blocks 134 has an identical construction. Accordingly, each of the blocks 134 may have a single piece or two piece designs. The blocks 134 are in surrounding contact with the power cell 118. Dimensions of the blocks 134 may vary based on the application. The blocks 134 include a number of holes 136 provided therethrough. The holes 136 on each of the blocks 134 are formed along the third axis C-C'. Referring to FIGS. 3 and 4, the hammer tool assembly 102 includes a frame assembly 140. The frame assembly 140 is coupled to the power cell 118 using the fastener 141. The fastener 141 passes through the frame assembly 140 and received into the through hole 128 of the power cell 118. The frame assembly 140 includes a first side plate 142 and a second side plate 144. The first and second side plates 142, 144 are aligned in a parallel manner with respect to the power cell 118. Further, the first and second side plates 142, 144 are configured to surround the power cell 118. Each of the first and the second side plates 142, 144 has an I-shaped cross section with respect to the first axis A-A' and the second axis B-B'.

Each of the first and second side plates 142, 144 has an inner wall 146 facing the power cell 118 and an outer wall 148 facing away from the power cell 118. The first and second side plates 142, 144 include a number of mounting bores 156 formed along the third axis C-C'. The mounting bores 156 are positioned proximate to the second end 126 of the power cell 118. The mounting bores 156 are arranged in such a manner that the mounting bores 156 coaxially align with the corresponding holes 136 of the blocks 134. Mechanical fasteners 158 are received into the mounting bores 156 of the first side plate 142 and the corresponding holes 136 of the blocks 134, and also the second side plate 144 and corresponding holes 136 of the blocks 134. The mechanical fasteners 158 couple the first and second side plates 142, 144 with the blocks 134. The mechanical fasteners 158 are embodied as threaded bolts having a relatively short length such that the length of the mechanical fasteners 158 is sufficient to engage with the respective side plate 142, 144 and the blocks 134. In alternate embodiments, the mechanical fasteners 158 may be turning pins, and the like. Four mechanical fasteners 158 are shown in association with the first and second side plates 142, 144 respectively. Alternatively, additional number of mechanical fasteners 158 may be used based on the application.

A flange member 150 along an outer periphery 152 of the outer wall 148 of the first and second side plates 142, 144 respectively. More particularly, the flange member 150 extends from the outer periphery 152 of the outer wall 148. The flange member 150 extends along the third axis C-C'. The flange member 150 is provided on the first and second side plates 142, 144. Alternatively, the flange member 150 is provided on any one of the first and second side plates 142, 144. The flange member 150 is provided along the entire length of the outer periphery 152 of the outer wall 148. Alternatively, the flange member 150 is provided on a bottom portion of the hammer tool assembly 102 proximate to the tool 104. A thickness and length of the flange member 150 may vary based on the application.

Additionally or optionally, a reinforcement member 153 is attached to the flange member 150 at the bottom portion of the hammer tool assembly 102. The reinforcement member 153 is attached to the first and second side plates 142, 144. Alternatively, the reinforcement member 153 may be attached to any one of the first and second side plates 142, 144. The flange member 150 includes a number of serrations 154 provided thereon. The serrations 154 extend outwards from the flange member 150. The serrations 154 are provided at the bottom portion of hammer tool assembly 102 proximate to the second end 126 of the power cell 118 more specifically, the serrations 154 are provided proximate to the portion of the hammer tool assembly 102 including the mechanical fasteners 158. Alternatively, the serrations 154 may be provided along an entire periphery of the flange member 150. The serrations 154 are provided on the first and second side plates 142, 144. Further, the serrations 154 are provided on the reinforcement member 153 corresponding to the serrations 154 provided on the flange member 150. Alternatively, the serrations 154 may be provided on any one of the first and second side plates 142, 144.

INDUSTRIAL APPLICABILITY

The present disclosure relates to the hammer tool assembly 102. The hammer tool assembly 102 includes the first and second side plates 142, 144. The first and second side plates 142, 144 have the I-shaped cross section.

The I-shaped cross section of the first and second side plates 142, 144 provides rigidity to the hammer tool assembly 102. During side loading the I-shaped sectioned provides stability and inhibits bending of the hammer tool assembly 102. The serrations 154 on the flange member 150 prohibit wear of the outer wall 148 of the hammer tool assembly 102. Further the serrations 154 secure the mechanical fasteners 158 during operation of the hammer tool assembly 102.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A hammer tool assembly for a machine, the hammer tool assembly comprising:

a power cell defining a first axis;

a tool coupled to one end of the power cell; and a frame assembly coupled to the power cell, the frame assembly comprising:

a first side plate and a second side plate, the first and second side plates positioned in surrounding contact with the power cell, wherein each of the first and second side plates has an I-shaped cross section along the first axis and a second axis, the second axis being perpendicular to the first axis;

a flange member including a plurality of serrations, the flange member extending from an outer periphery of an outer wall of at least one of the first and second side plates, the flange member extending perpendicularly to the second axis along a third axis, wherein the third axis is perpendicular to the first and second axes respectively; and a plurality of blocks provided in surrounding contact with the power cell and an inner wall of the first and second side plates respectively, the plurality of blocks positioned proximate to the one end of the power cell, wherein the plurality of blocks are spaced apart from each other with respect to the first axis, wherein mounting bores positioned at one end of the first and second side plates respectively are arranged to coaxially align with corresponding openings provided on respective sides of each of the plurality of blocks, such that the mounting bores and the corresponding openings are configured to receive mechanical fasteners therethrough.

* * * * *